US009136083B2

(12) United States Patent
Brakefield et al.

(10) Patent No.: US 9,136,083 B2
(45) Date of Patent: Sep. 15, 2015

(54) ENCLOSED BUS BAR FUSE HOLDER

(71) Applicant: Marathon Special Products, Fort Wayne, IN (US)

(72) Inventors: Timothy Joseph Brakefield, Perrysburg, OH (US); Joseph Brown, Waterville, OH (US); James Hemp, Luckey, OH (US)

(73) Assignee: Regal Beloit America, Inc., Fort Wayne, IN (US)

( * ) Notice: Subject to any disclaimer, the term of this patent is extended or adjusted under 35 U.S.C. 154(b) by 251 days.

(21) Appl. No.: 13/835,247

(22) Filed: Mar. 15, 2013

(65) Prior Publication Data

US 2014/0273640 A1 Sep. 18, 2014

(51) Int. Cl.

| | |
|---|---|
| ***H01R 9/03*** | (2006.01) |
| ***H01H 85/20*** | (2006.01) |
| ***H01R 13/648*** | (2006.01) |
| ***H01R 13/66*** | (2006.01) |
| ***H01R 13/68*** | (2011.01) |
| ***H01H 85/22*** | (2006.01) |

(52) U.S. Cl.

CPC ..... *H01H 85/2045* (2013.01); *H01H 85/202* (2013.01); *H01H 85/22* (2013.01); *H01R 9/03* (2013.01); *H01R 13/648* (2013.01); *H01R 13/66* (2013.01); *H01R 13/68* (2013.01); *H01H 2085/209* (2013.01)

(58) Field of Classification Search

CPC ..... H01R 24/00

USPC ..... 439/620.29, 621, 622, 830–833, 250, 439/251, 252, 366, 620.26, 620.27, 620.28, 439/620.3, 620.33, 620.34, 698, 874; 337/211, 221, 227, 229, 230, 208, 213, 337/214, 216, 156–159

See application file for complete search history.

(56) References Cited

U.S. PATENT DOCUMENTS

| | | | | |
|---|---|---|---|---|
| 4,178,061 | A * | 12/1979 | Ahroni | 439/620.29 |
| 5,616,054 | A * | 4/1997 | Quinlan | 439/620.26 |
| 5,969,587 | A * | 10/1999 | Combas | 335/132 |
| 6,727,797 | B1 * | 4/2004 | Bruchmann | 337/210 |
| 6,759,939 | B2 * | 7/2004 | Sudan et al. | 337/211 |
| 7,355,503 | B2 * | 4/2008 | Buettner | 337/211 |
| 7,561,018 | B2 | 7/2009 | Buettner | |
| 8,310,333 | B2 | 11/2012 | Ventura et al. | |
| 2006/0250210 | A1 * | 11/2006 | Dowil et al. | 337/227 |
| 2012/0056708 | A1 * | 3/2012 | Ventura et al. | 337/207 |

FOREIGN PATENT DOCUMENTS

EP 0 435 926 A1 12/1990

* cited by examiner

*Primary Examiner* — Abdullah Riyami
*Assistant Examiner* — Harshad Patel
(74) *Attorney, Agent, or Firm* — Reinhart Boerner Van Deuren P.C.

(57) ABSTRACT

There is provided a bus bar fuse holder configured to receive a fuse link and couple each end of the fuse link to a line conductor and a load conductor within the holder. The bus bar holder includes a housing that defines a space in the housing proximate one of a line terminal and load terminal. A clamp unit is configured to receive a portion of a bus bar with the lineup clamp unit disposed in the space defined in the housing. The space configured in the housing also encloses a substantial portion of the bus bar within the housing in a space defined between U-shaped members of the clamp unit.

20 Claims, 4 Drawing Sheets

ENCLOSED BUS BAR FUSE HOLDER

FIELD OF THE INVENTION

This invention relates generally to fuse holders, and more particularly to modular fuse holders configured for bus bar connections.

BACKGROUND OF THE INVENTION

In some industries, for example solar panel manufacturing and solar array fields, each string of solar panels from an array of solar panels has to be overload protected, for example by using fuses. In a typical arrangement the solar array strings from a solar panels installation are combined into one output bus. In some circumstances, the output bus must also be insulated which requires insulators particularly fabricated for such arrangement.

It is known that end users have used traditional bare wire fuse holders and have fabricated special comb bus bars that fit into each bare wire terminal. Such special comb bus bar adds costs and fabrication time to the solar panel field. Another method for providing over current protection for a solar array is to provide again insulated comb style bus bars that assemble with the fuse holder. Attempts have been made to eliminate the bare wire type terminal in the fuse holders to use with a special comb bus bars, however such arrangements increase the size of the overall assembly which creates not only additional costs to the overall product but also housing issues for the circuit or fuse holders. Such specialized and unique pieces of equipment does not provide for standardization and also increases the cost of an installation.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, it is also an objective that all of the aforesaid advantages and objectives be achieved without incurring any substantial relative disadvantage.

SUMMARY OF THE INVENTION

There is provided a bus bar fuse holder configured to receive a fuse link and couple each end of the fuse link to a line conductor and a load conductor within the holder. The bus bar holder includes a housing that defines a space in the housing proximate one of a line terminal and load terminal. A receptacle in the housing is configured to receive the fuse link with the receptacle configured to rotate the fuse line into mechanical and electrical contact with the line conductor and load conductor. The line terminal and load terminal, respectively, are in electrical communication with the line conductor and load conductor.

A clamp unit is configured to receive a portion of a bus bar with the lineup clamp unit disposed in the space defined in the housing. The space configured in the housing also encloses a substantial portion of the bus bar within the housing in a space defined between U-shaped members of the clamp unit.

A fastener is coupled to the clamp unit and configured to engage the bus bar received in the clamp unit with the fastener accessible through an orifice defined in the housing and aligned with the fastener. The housing also defines a lip extending from the housing above the opening configured to receive the bus bar, with the lip configured to receive a cover configured to close the opening in the housing. A portion of the bus bar disposed in the fuse holder housing is thus insulated by the fuse holder housing. In a typical installation, the bus bar is the usual and convenient size for the particular application.

The apparatus of the present invention is of a construction which is both durable and long lasting, and which will require little or no maintenance to be provided by the user throughout its operating lifetime. Finally, all of the aforesaid advantages and objectives are achieved without incurring any substantial relative disadvantage.

DESCRIPTION OF THE DRAWINGS

These and other advantages of the present disclosure are best understood with reference to the drawings, in which.

DETAILED DESCRIPTION OF THE EXEMPLARY EMBODIMENTS

Figure 1:
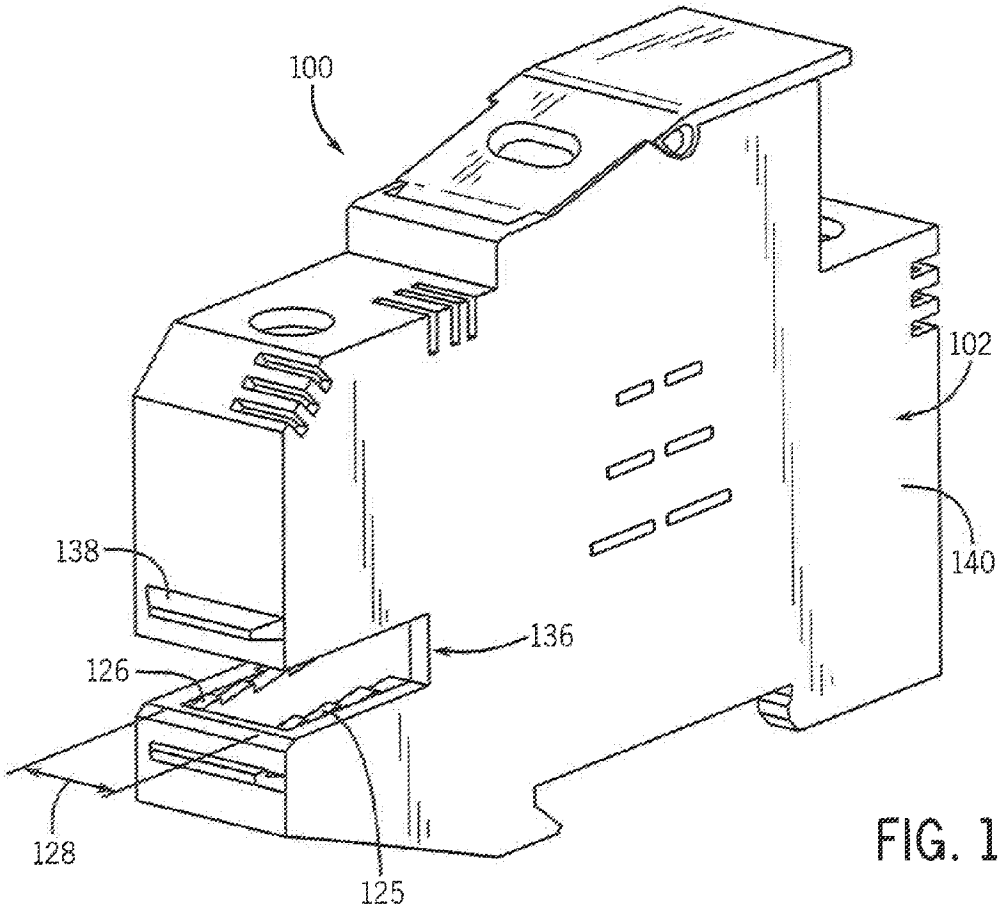
FIG. 1 is a perspective illustration of an exemplary embodiment of a bus bar fuse holder, with the fuse holder defining an opening configured to receive a portion of a bus bar and substantially insulate the surface area of the bus bar within the housing.

This disclosure relates to an enclosed insulating body, hinge style fuse holder, which has one or more standard wire terminals, in addition to a bus bar clamping terminal. FIG. 1 illustrates an exemplary embodiment of the bus bar fuse holder 100 which includes a housing 102. The housing 102 may have one or more covers 140 which enclose one side of the housing 102. The housing 102 defines a housing opening or slot 136 in at least one end of the bus bar fuse holder 100. The opening 136 is configured to receive a portion of bus bar 134 with the housing 102 configured to provide insulation around the bus bar 130.

For purposes of this application, the bus bar 130 is substantially insulated by the housing 102 of the bus bar fuse holder 100. As used herein, substantially insulated by the housing means at least seventy-eight percent of the bus bar surface area is enclosed within the housing 102 of the fuse holder 100.

Figure 3:
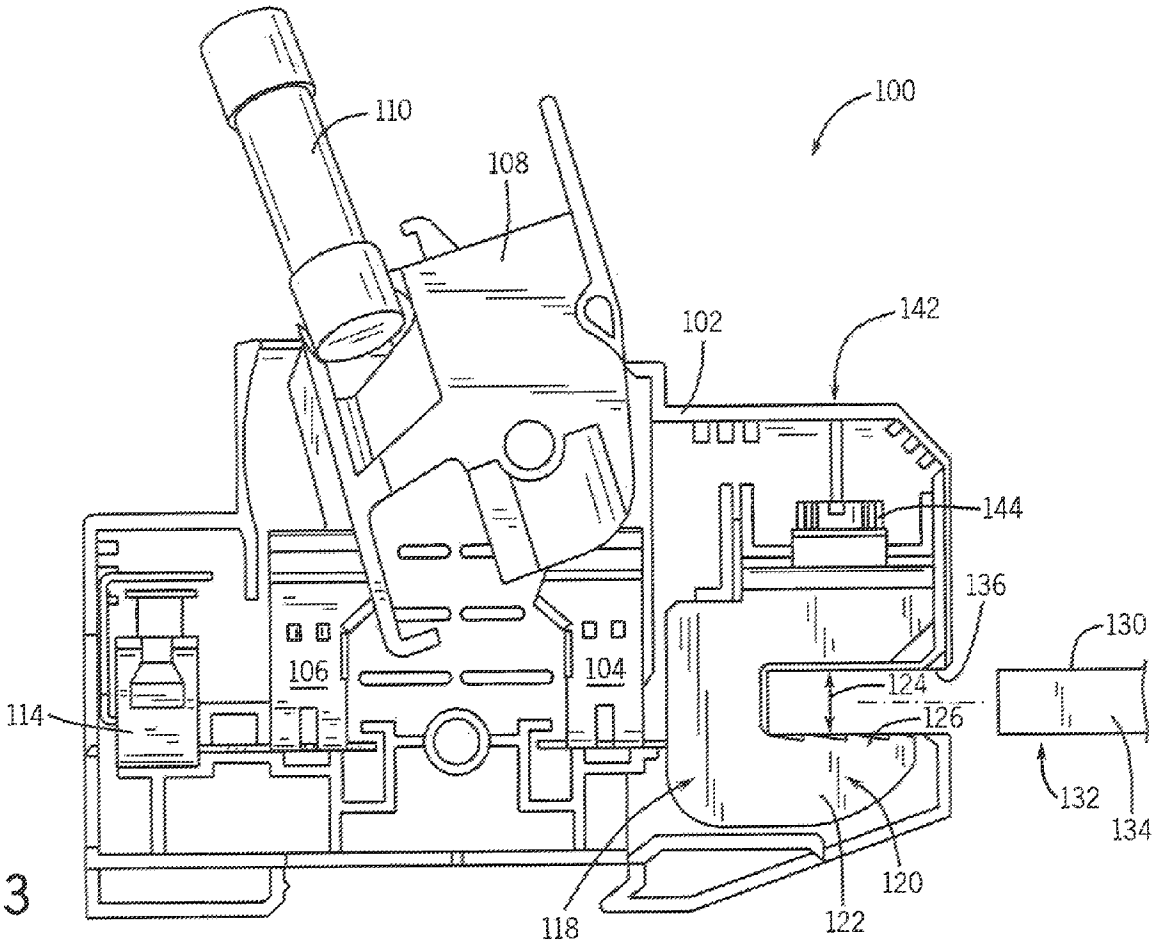
FIG. 3 is a side interior view of the bus bar fuse holder illustrated in FIG. 1 with the side cover of the housing removed and illustrating positioning of a bus bar into the fuse holder housing.

The bus bar fuse holder 100 is configured to receive a fuse link 110 and couple each end of the fuse link to a line conductor 104 and a load conductor 106 (see FIG. 3). The housing 102 includes a receptacle 108 configured to receive the fuse link. The receptacle is configured to rotate the fuse link into mechanical and electrical contact with the line conductor 104 and the load conductor 106. A line terminal 112 is configured for electrical communication with the line conductor 104 and a load terminal 114 is configured for electrical communication with the load conductor 106. One of the line terminal 112 and load terminal 114 are configured to receive a wire conductor 146.

The housing 102 defines a space 116 proximate one of the line terminal 112 and load terminal 104 and facilitates electrical communication with one of the line conductor 104 and the load conductor 106. As illustrated in the figures, the space 116 is proximate the line terminal. It should be understood that the housing 102 can be configured to have an opening space 116 on either or both sides of the housing 102 as required by a specific application, as determined by a user.

A clamp unit 118 is configured for disposition in the space 116 defined in the housing. The clamp unit 118 is configured in a U-shape, including two spaced apart U-shaped members 120 which define a space 124 between the U-shaped members 120. In the illustrations, the clamp unit 118 is a unitary member with the two U-shaped members 120 coupled together at their respective top portion. The U-shaped members 120 further define a space 128 between each leg of each member. (See FIGS. 1 and 3). In one embodiment, the clamp unit 118 is configured with one leg of each U-shaped member 120 defining a plurality of protrusions 126 extending into the space 124 between the legs of the clamp unit 118.

Figure 2:
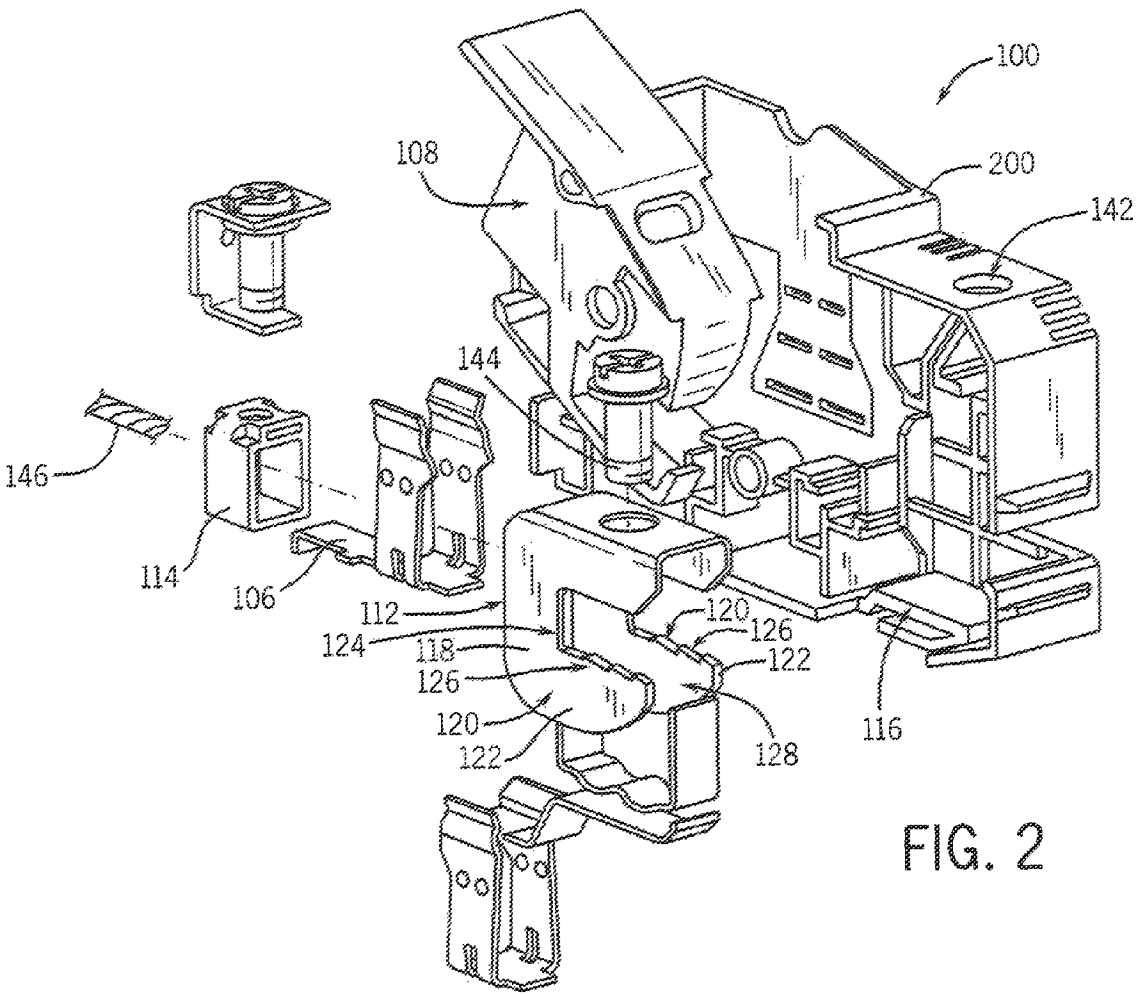
FIG. 2 is a perspective, exploded view of the bus bar fuse holder illustrated in FIG. 1.

The housing 102 further defines an opening 136 with the opening 136 in communication with the space 124 defined by the legs and members 120, 122 of the clamp unit 118. In use, a bus bar 130 is inserted into the opening 136 and engaged in the space 124 defined by the clamp unit 118. A fastener 144 is coupled to the clamp unit and is configured to engage the bus bar received in the clamp unit 118. The fastener is accessible through an orifice 142 defined in the housing 102 and aligned with the fastener 144. (See FIGS. 2 and 3). A typical bus bar defined a rectangular cross section 132 and is of a length, as determined by the user, necessary for the particular application. The protrusions 126 and the fastener 144 secure the bus bar 130 in the clamp unit 118.

Figure 4:
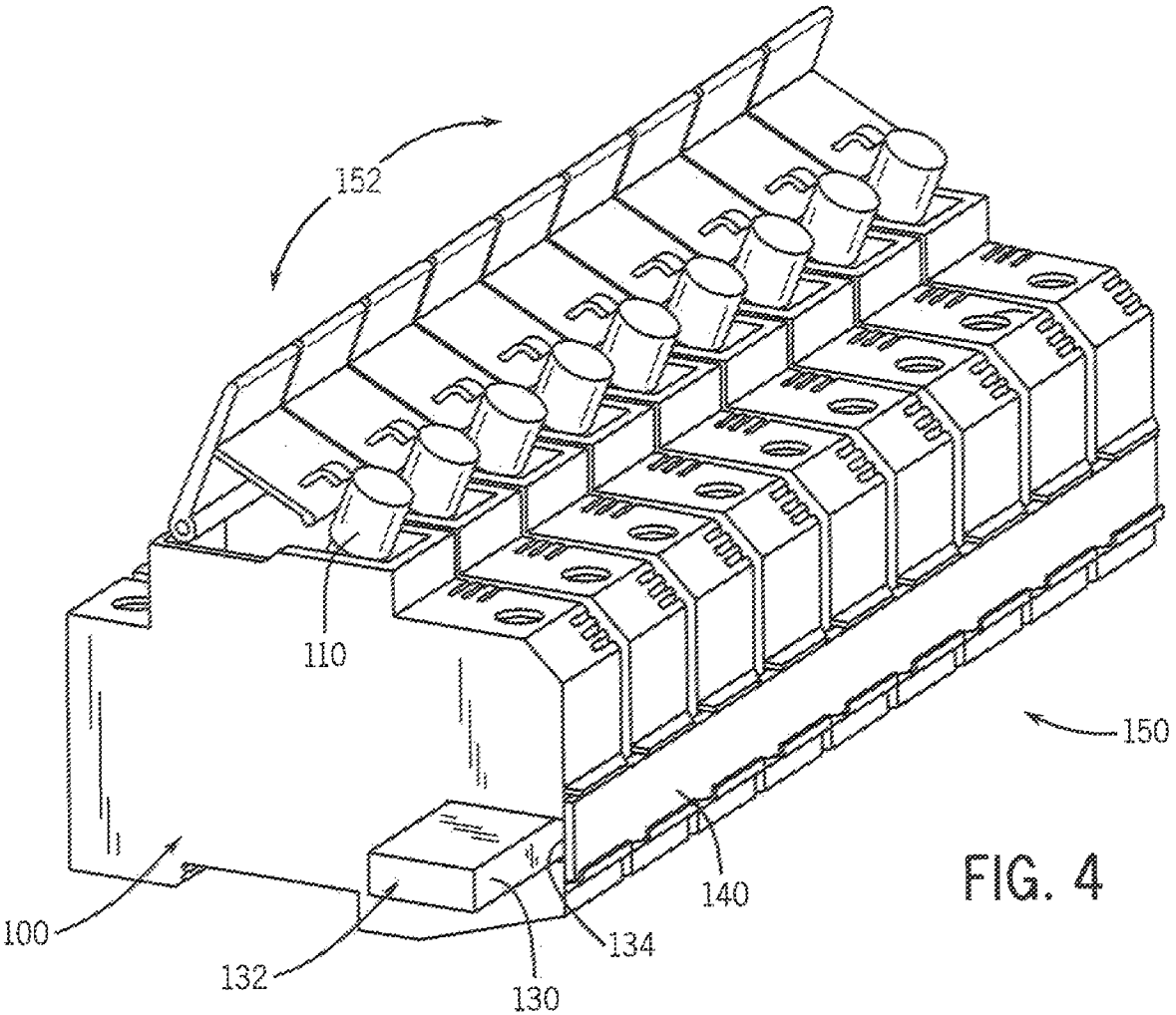
FIG. 4 is a perspective view of a plurality bus bar fuse holders illustrated in FIG. 1, in an array, coupled to a single bus bar with the bus bar substantially insulated along its length by the plurality of bus bar fuse holder housings.

The housing also defines a lip 138, typically above the opening 136 with the lip configured to receive a cover 140 configured to close the opening in the housing. (See FIG. 4). With the bus bar 130 installed in the clamp unit 118, as mentioned above, seventy-eight percent of the surface area of the bus bar 130 is enclosed and insulated within the housing 102. With the cover 140 in place on the lip 138 approximately ninety three percent of the surface area of the bus bar is covered and insulated with the bus bar fuse holder 100 of this disclosure. The cover can be used as a marking strip indicating information relative to the particular installation and application.

There is also disclosed a bus bar fuse holder array 150 which is composed of a plurality of bus bar fuse holders 152 as described above. Each fuse holder comprises a housing, a receptacle, line terminal, a load terminal, and a clamp unit as described above.

The bus bar fuse holder array 150 in addition to the plurality of bus bar fuse holders 152 includes a single bus bar 130 coupled to each fuse holder clamp unit 118 with each fuse holder 100 positioned adjacent to another fuse holder 100. (See FIG. 4). A single cover 140 is coupled to each fuse holder, with the cover extending the full length of the plurality of bus bar fuse holders 152 in the array 150.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of the present mechanism has been shown and described with reference to particular embodiments and applications thereof, it has been presented for purposes of illustration and description and is not intended to be exhaustive or to limit the disclosure to the particular embodiments and applications disclosed. It will be apparent to those having ordinary skill in the art that a number of changes, modifications, variations, or alterations to the mechanism as described herein may be made, none of which depart from the spirit or scope of the present disclosure. The particular embodiments and applications were chosen and described to provide the best illustration of the principles of the mechanism and its practical application to thereby enable one of ordinary skill in the art to utilize the disclosure in various embodiments and with various modifications as are suited to the particular use contemplated. All such changes, modifications, variations, and alterations should therefore be seen as being within the scope of the present disclosure as determined by the appended claims when interpreted in accordance with the breadth to which they are fairly, legally, and equitably entitled.

What is claimed is:

1. A bus bar fuse holder, the holder configured to receive a fuse link and couple each end of the fuse link to a line conductor and a load conductor within the holder, the bus bar fuse holder comprising:

a housing;

a receptacle in the housing configured to receive the fuse link, with the receptacle configured to rotate the fuse link into mechanical and electrical contact with the line conductor and load conductor;

a line terminal in electrical communication with the line conductor;

a load terminal in electrical communication with the load conductor; and a clamp unit configured to receive a portion of a bus bar, with the clamp unit disposed in a space defined in the housing proximate one of the line terminal and load terminal and in electrical communication with one of the line conductor and load conductor, with the space configured to enclose the portion of the bus bar within the housing.

2. The bus bar fuse holder of claim 1, further comprising the clamp unit configured in a U-shape, including two spaced apart U-shaped members which define a space between the U-shaped members and define a space between each leg of each member.

3. The bus bar fuse holder of claim 2, further comprising the clamp unit configured with one leg of each U-shape member defining a plurality of protrusions extending into the space between the legs of the clamp unit.

4. The bus bar fuse holder of claim 2, further comprising the housing defining an opening, with the opening in communication with the space defined by the legs and members of the clamp unit.

5. The bus bar fuse holder of claim 4, further comprising the housing defining a lip extending from the housing above the opening, with the lip configured to receive a cover configured to close the opening in the housing.

6. The bus bar fuse holder of claim 5, wherein the cover is a marking strip.

7. The bus bar fuse holder of claim 1, further comprising a fastener coupled to the clamp unit and configured to engage the bus bar received in the clamp unit, with the fastener accessible through an orifice defined in the housing and aligned with the fastener.

8. The bus bar fuse holder of claim 1, with a second clamp unit disposed in a second space defined in the housing proximate one of the line terminal and load terminal and in electrical communication with one of the line conductor and load conductor.

9. The bus bar fuse holder of claim 1, further comprising one of the line terminal and load terminal configured to receive a wire conductor.

10. The bus bar fuse holder of claim 1, wherein the bus bar defines a rectangular cross-section.

11. A bus bar fuse holder array, with each holder of the array configured to receive a fuse link and couple each end of the fuse link to a line conductor and a load conductor within the holder, the bus bar fuse holder array comprising:

a plurality of bus bar fuse holders, with each fuse holder comprising:

a housing;

a receptacle in the housing configured to receive the fuse link, with the receptacle configured to rotate the fuse link into mechanical and electrical contact with the line conductor and load conductor;

a line terminal in electrical communication with the line conductor;

a load terminal in electrical communication with the load conductor; and a clamp unit, the clamp unit disposed in a space defined in the housing proximate one of the line terminal and load terminal and in electrical communication with one of the line conductor and load conductor, with the space configured to substantially enclose the portion of the bus bar within the housing;

a single bus bar coupled to each fuse holder clamp unit, with each fuse holder positioned adjacent to another fuse holder; and a single cover coupled to each fuse holder, the cover extending the full length of the plurality of bus bar fuse holders in the array.

12. The bus bar fuse holder array of claim 11, further comprising the clamp unit configured in a U-shape, including two spaced apart U-shaped members which define a space between the U-shaped members and define a space between each leg of each member.

13. The bus bar fuse holder array of claim 12, further comprising the clamp unit configured with one leg of each U-shape member defining a plurality of protrusions extending into the space between the legs of the clamp unit.

14. The bus bar fuse holder array of claim 12, further comprising the housing defining an opening, with the opening in communication with the space defined by the legs and members of the clamp unit.

15. The bus bar fuse holder array of claim 14, further comprising the housing defining a lip extending from the housing above the opening, with the lip configured to receive the cover configured to close the opening in the housing.

16. The bus bar fuse holder array of claim 15, wherein the cover is a marking strip.

17. The bus bar fuse holder array of claim 11, further comprising a fastener coupled to the clamp unit and configured to engage the bus bar received in the clamp unit, with the fastener accessible through an orifice defined in the housing and aligned with the fastener.

18. The bus bar fuse holder array of claim 11, with a second clamp unit disposed in a second space defined in the housing proximate one of the line terminal and load terminal and in electrical communication with one of the line conductor and load conductor.

19. The bus bar fuse holder array of claim 11, further comprising one of the line terminal and load terminal configured to receive a wire conductor.

20. The bus bar fuse holder array of claim 11, wherein the bus bar defines a rectangular cross-section.

* * * * *